United States Patent [19]

Lingeman

[11] 4,366,769

[45] Jan. 4, 1983

[54] SMALL BOATS

[76] Inventor: Whitten L. Lingeman, 1106 Collingwood Dr., Indianapolis, Ind. 46208

[21] Appl. No.: 47,231

[22] Filed: Jun. 11, 1979

Related U.S. Application Data

[63] Continuation of Ser. No. 790,428, Apr. 25, 1977, abandoned.

[51] Int. Cl.[3] ..... B63B 3/00

[52] U.S. Cl. ..... 114/352

[58] Field of Search ..... 9/1.1, 1.2, 2 R, 2 S, 9/2 C, 2 F, 6 R, 6 P, 4 R; 114/61, 77 R, 77 A, 352, 353, 354, 355, 356, 357, 358, 359; 224/42.01

[56] References Cited

U.S. PATENT DOCUMENTS

| | | | |
|---|---|---|---|
| 1,445,792 | 2/1923 | Olson | 9/2 R |
| 3,684,139 | 8/1972 | Johnson | 9/2 F |

*Primary Examiner*—Trygve M. Blix
*Assistant Examiner*—Jesus D. Sotelo

[57] ABSTRACT

A two section structure adapted to be selectively converted into a single hull six passenger boat, a double hull six passenger boat and an enclosable container which may be opened from one end or from either side. The two, generally similar, forward and rear small boat sections are adapted to be hingedly interconnected along mating end walls or, mating side walls, such that, the two sections may be selectively pivoted from a fore and aft alignment to a side by side alignment to form a wide beam double hulled boat or, pivoted into an overlying relationship to form an enclosed container. Each small boat section is provided with eight strategically located hinge joints. One half of a mating hinge joint is located on one section and the other mating joint is located on the other small boat section. The interconnecting hinge joints embody rounded corners at points of contact with a mating joint and, beveled hinge joint apertures to ease insertion of the tapered hinge joint connector pin which, when inserted beyond the first two hinge joints, does in effect, provide self-alignment of the adjacent mating hinge joints. Alignment plugs with mating sockets insure positive contact between the two boat sections and prevent movement of the abutting surfaces.

2 Claims, 9 Drawing Figures

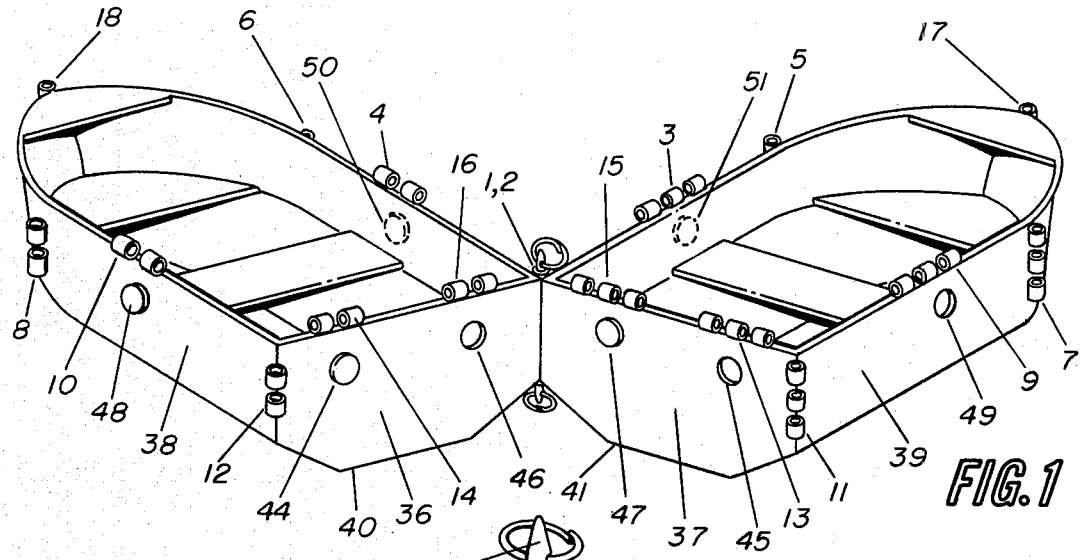
FIG. 1
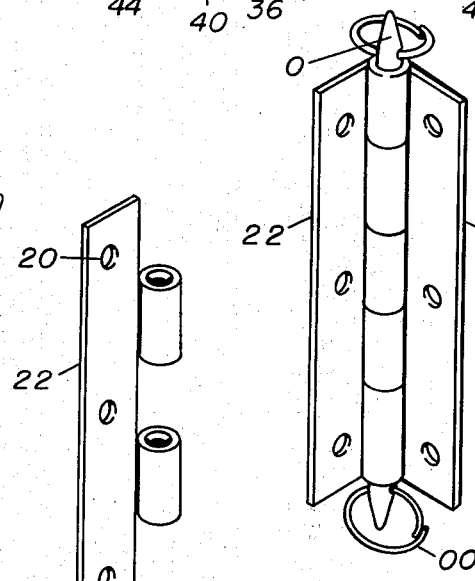
FIG. 2
FIG. 2a
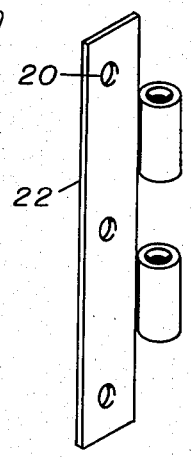
FIG. 2b
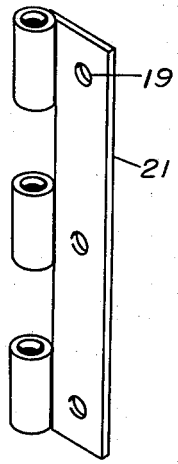
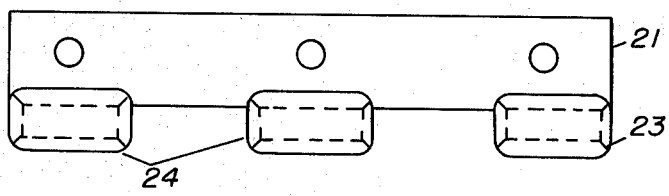
FIG. 3
FIG. 3b
FIG. 3a
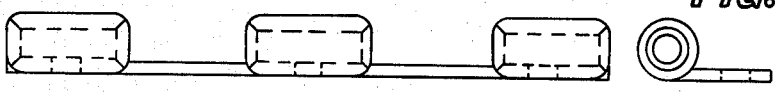
FIG. 4
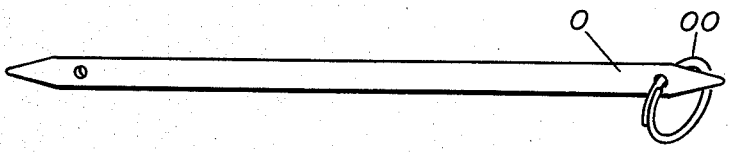

SMALL BOATS

This is a continuation of Ser. No. 790,428, filed Apr. 25, 1977, now abandoned.

BACKGROUND OF THE INVENTION

The present invention relates to small boats. More particularly to a small boat comprised of two generally similar sections releasably interconnected by novel hinge joints. Each small boat section is a rigid structure, nonsinkable, self contained unit adapted to be used in various combinations with the other unit. Each releasable hinge is comprised of two mating parts. One mating half is mounted on each small boat section and, so located that when the two mating parts are connected and, the hinge connector pin inserted, the two sections form an integral structure.

Despite revolutionary advances in technology during the last century, the small boat, commonly referred to as a dinghy, punt, skiff and tender has undergone very little basic change since primitive man first hollowed out a tree log and set himself afloat. Recent years have seen a phenomenal growth in the popularity of water related recreational activities. To satisfy this demand, the small boat industry has brought forth a wide range of models from which to chose. Unfortunately, however, these have generally been of the fixed size and shape mono-hull type; similar in basic respect to primitive man's hollowed log. As such, when mishandled or over-loaded, they are prone to capsize. Tragically, each boating season brings an ever increasing loss of life. Many of these accidents might have been avoided if the user had been able to select a boat better suited for his need at that particular time.

Today, even though the small boat user has a wide range of models to choose from, there are still only a limited number of basic types available to him. These are: the rigid hull dinghy, the rubber inflatable, the folding boat and, the hinge connected luggage carrier boat combination. All have numerous disadvantages affecting safety, operation and serviceability. For example, the most widely used of the types available, the rigid hull two to three person dinghy has the inherent disadvantage of having a fixed size and shape, thus affording the user no flexibility to adjust the size and shape to meet his varying requirements. Consequently, when called upon to perform a job beyond their normal capacity, they are often overloaded and, in danger of being swamped or capsizing. This is especially true if rough water and adverse weather conditions are encountered. Also, when this type small boat, with its fixed size, is used as a tender aboard a larger sailboat or power cruiser, they often take up deck space for stowage well out of proportion to the cargo capacity they make available. A further disadvantage is the fact that the use of this type small boat is limited to that of a single purpose water-craft.

The three to four person inflatable, made of rubber, has the inherent disadvantage of: fixed size, shape and capacity. It has the further disadvantage of being highly susceptible to damage such as chafing, puncturing and, gradual deterioration of its parent material. Small inflatables are extremely hard to handle in a current or moderate surface wind. They are subject to be punctured and, being swamped if overloaded, they cannot be sailed properly and, the user must have an air pump and repair kit constantly available.

The folding boat, made of canvas and wood, is highly subject to damage by rough handling due to its fragile construction. Its canvas and wood parts are subject to deterioration and, its fixed size and shape offer the user no flexibility to suit his changing demands. Like the others, it is subject to being swamped and sinking if operated under adverse conditions.

The two or three person luggage carrier/boat combination has numerous disadvantages. For example, its shallow draft and square ends make it hard to handle under anything except calm water and weather conditions. Its primary purpose is that of a luggage carrier, unless one prefers, a floating box which is sinkable and easily swamped in rough water. A further critical disadvantage is the nature of the hinge which interconnects its two sections. The hinge joint apertures are set in a flat surface and, the joint corners are sharp and unrounded. This makes engagement of mating hinge joints extremely difficult and, insertion of the flat ended hinge pin, all but impossible, unless all of the hinge joint apertures are in perfect alignment.

It is accordingly, an object of the present invention, to provide a new type of small boat structure and, a hinge which affords ease of hinge joint engagement and insertion of the hinge connector pin; the combination, of which, effectively overcomes the disadvantages to be found in the small boats of the afore described types.

SUMMARY OF THE INVENTION

A primary object of this invention is the provision of a two section hinge connected boat structure which one person can easily and quickly convert into a variety of useful combinations without the necessity of tools to change from one combination to another. To this end, the present invention contains the embodiment of a novel hinge whereby all hinge joints have rounded corners and beveled apertures to ease engagement of the mating hinge joints and insertion of the tapered hinge joint connector pin. The tapered hinge pin inconjunction with the beveled hinge joint apertures does, in effect, make the hinge joints "self-aligning" when the hinge pin is inserted. Alignment of the mating hinge joints is further eased by adjacently positioned hinge joint alignment plugs and mating sockets which provide positive contact between the two sections and prevent movement of their abutting surfaces.

A further object of the present invention is to afford the small boat user the flexibility and safety of changing the size and shape of his boat to better suit his immediate needs. Heretofore, such an option, now made possible by the two boat section, releasable hinge connected principal, has not been available.

A further object is to give the small boat user an inherently safe, easily handled seaworthy small boat of adequate capacity which has good sailing and rowing characteristics. This has been accomplished with the fore and aft alignment of the two non-sinkable interconnected boat sections which form a rigid "double-ended" boat hull. This small boat hull form, similar in shape to Coast Guard Rescue Craft and the Grand Banks fishing dory is recognized as one of the most seaworthy hull forms known.

Another object of the present invention, is to make available to the small boat user a hull form which combines maximum stability with ease of handling. This has been achieved by hinge connecting two small boat sections in a side by side alignment similar to a seaworthy Catamaran. This hull arrangement provides stability, with inherent safety, by doubling the boats beam over that of a mono-hull. This is of paramount importance to hunters, fisherman and, for family boating.

A further object of the invention is the provision whereby the user can convert the two hinge connected small boat sections into a weatherproof closed container. This useful arrangement is made possible because both sections are the same size and shape. With only the end wall hinges installed, the top section may be closed lengthwise. With only one of the side wall hinges installed, the top section may be closed from either side. To secure the container, all hinge joint connector pins are installed in their respective hinge joint apertures.

Other objects and advantages of the invention will become apparent during the course of the following description when taken in connection with the accompanying drawings.

DESCRIPTION OF THE DRAWINGS

In FIG. 1, the forward section releasable hinge means and other parts are designated by "odd" numbers. In FIG. 1 the rear section releasable hinge means and other parts are designated by "even" numbers. Mating hinge parts, alignment plugs and sockets have their numerals in sequence. For example, hinge joint number 1 mates with hinge joint number 2, hinge joint number 3 mates with hinge joint number 4, alignment plug 44 mates with socket 45, etc. In the drawings:

FIG. 1 is a perspective view of the forward and rear sections;

FIG. 2 is a perspective view of a three joint hinge locking plate 21 with three mounting holes 19 shown;

FIG. 3 is a perspective view of a two joint hinge locking plate 22 with three mounting holes 20 shown;

FIG. 4 is a perspective view showing hinge locking plates 21 and 22 connected by hinge joint connector pin O with both circular snap rings OO installed in their retainer holes;

FIG. 8 is a perspective view of the two boat sections aligned in a side by side arrangement and interconnected by one end wall side hinge, one side wall top hinge and, one front forequarter hinge;

FIG. 9 shows the two boat sections in an overlying position and interconnected by both end wall top hinges and by both side wall top hinges.

DETAILED DESCRIPTION

Referring more specifically to the drawings, a structure which embodies the features of the present invention is indicated generally in FIG. 1. In one configuration, the two boat sections are adapted to be pivoted into a fore and aft alignment to form the six passenger boat shown in FIG. 7.

In FIG. 8 the two boat sections are shown in side by side alignment forming a two hulled six passenger boat. In FIG. 9 the two boat sections are pivoted into an overlying relationship to form an enclosed container which, by the selective use of the top end wall hinges or, the top side wall hinges may be opened lengthwise or from either side.

Both sections, similar in size and shape, comprise flat end walls 36 and 37, flat side walls 38 and 39 and, flat rectangular bottoms 40 and 41. On each boat section, the rear end wall and the two side walls converge at a pointed forward end to define a closed watertight periphery about the bottom. The flat surface portion of the upstanding side walls and both upstanding end walls are in vertical alignment with the boat section waterline. At the waterline level, the side walls of each boat section taper inward to the flat bottom.

Figure 7:
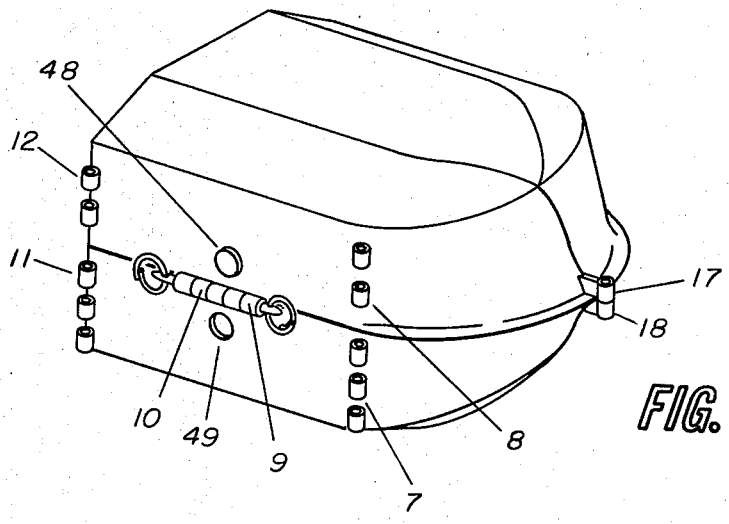
FIG. 7 is a perspective view of the two boat sections aligned in a fore and aft arrangement and interconnected by both top end wall hinges and by both side end wall hinges.

FIG. 1 shows the two boat sections as they would appear during conversion from a fore and aft alignment, FIG. 7, to a side by side position shown in FIG. 8. Conversely, the two boat sections would appear in a similar position if being converted from the side by side arrangement to a fore and aft alignment.

If the conversion is being made from the fore and aft to the side by side boat section alignment, hinge joints number 1 and 2 would be interconnected and the forward and rear sections would be pivoted into side by side alignment engaging socket 50 with alignment plug 51 and, interconnecting hinge joint 4 with hinge joint 3, wherein forequarter hinge joint 6 would engage its mating joint 5. Upon the engagement of the afore mentioned hinge joints and, alignment plug and socket, the respective hinge joint connector pins O and their respective circular snap-rings would be installed.

If the conversion is being made from a side by side boat section position back to a fore and aft alignment, hinge joints number 1 and 2 would remain connected as shown in FIG. 1 and, the rear section would be pivoted into longitudinal alignment with the forward section shown in FIG. 1 engaging alignment plugs 47 and 44 with alignment sockets 46 and 45 and, concurrently, engaging hinge joints number 15 and 16, 13 and 14 and, end wall side hinge joints number 11 and 12, wherein all hinge joint connector pins O and all circular snap-rings OO are installed.

FIG. 2 shows a three joint hinge with mounting plate 21 and mounting holes 19. This hinge section cooperates with two joint hinge FIG. 3, which has mounting holes 20 to form FIG. 4 which is shown with tapered hinge joint connector pin O and both circular snap-rings OO installed. All hinges when interconnected are of the same length. This length being equal to the vertical portion of an upstanding side wall. The apertures number 17 and 18 at the pointed end of each boat section define a vertical length equal to one half the height of the vertical portion of an upstanding side wall 38 and 39.

Figure 5:
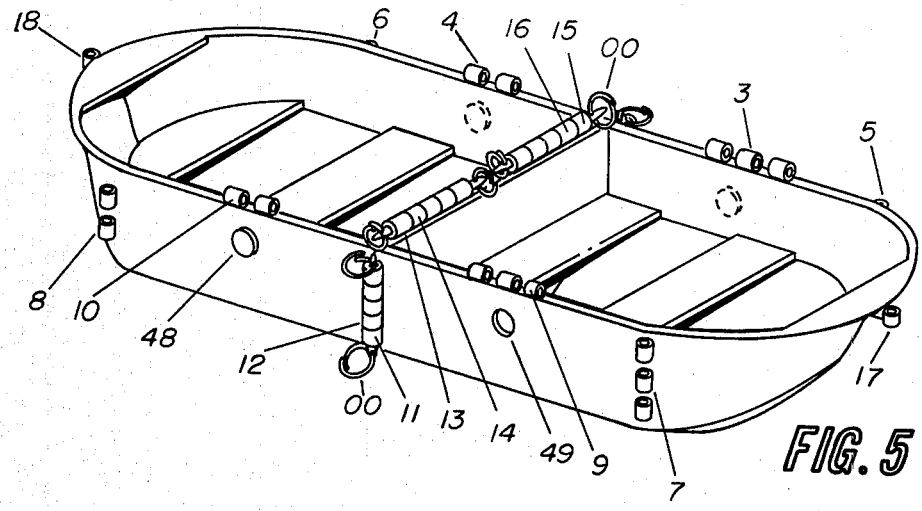
FIG. 5 shows a plan, front and end view of a three joint hinge locking plate 21, with rounded hinge joint corners 25 beveled aperture openings 23.
Figure 6:
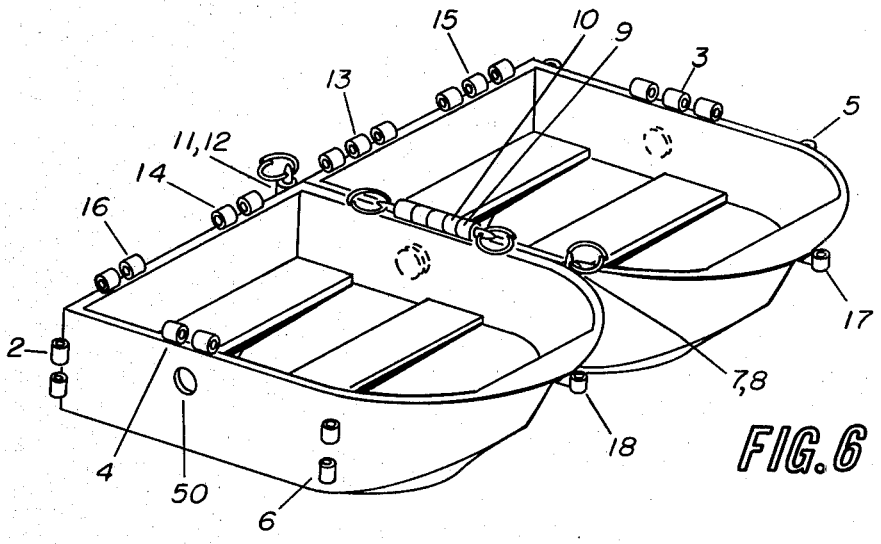
FIG. 6 shows a front view of a hinge joint tapered connector pin O with one circular snap-ring OO installed.

Functional features of a three joint hinge locking plate are shown in FIGS. 5A, 5B and 5C wherein, the hinge joint corners 25 have been rounded to ease interconnecting of the two mating hinge joints. Sharp square corners of a conventional type hinge require exact alignment of the two mating parts before they can be interconnected. All hinge joint apertures have their entry opening beveled at an angle of 45°. The beveled entry into the aperture 23 provides for ease of insertion and unrestricted passage of the hinge joint connector pin O thru all of the interconnected mating hinge joints. The embodiment of a 15° taper and a rounded end on each end of the hinge joint connector pin O of FIG 6 inconjunction with the 45° bevel 23 of all hinge joint aperture openings, makes the hinge joint self-aligning as the 15° tapered end and the full hinge pin diameter has been inserted and, passes beyond the first two mating hinge joints.

To relieve stress or the hinge joints when they are interconnected and, to provide positive contact between abutting surfaces, round plugs with beveled top corners are used inconjunction with a beveled mating socket. The alignment plugs and their mating sockets further serve to aid engagement of the two mating hinge joints as they come together.

The two boat sections in fore and aft alignment as shown in FIG. 7 would serve as a basic starting configuration, from which, conversion to the other boat section combinations would be initiated.

In the fore and aft alignment of the two boat sections, both top rear end wall hinge joints 13-14 and 15-16 are interconnected and, alignment plugs 44 and 47 are inserted into their alignment sockets 45 and 46. Both side end wall hinge joints 1-2 and 11-12 are interconnected. When all hinge joint connector pins O and all circular snap-rings OO have been installed, the two boat sections are joined together to form an integral structure.

To convert the two boat sections from fore and aft alignment to side by side alignment, one circular snap-ring is removed from each of the hinge joint connector pins securing hinge joints 13-14 and 15-16 wherein, the hinge joint connector pins are withdrawn from the hinge joint apertures using the circular snap ring OO which is still installed, to pull the connector pin O free. Each hinge joint connector pin is removed in a like manner. The hinge joint connector pin O is now removed from side end wall hinge 11-12 leaving only hinge joints 1-2 fully interconnected as shown in FIG. 1. Using hinge joints 1-2 as a pivot point, the rear section FIG. 1 is rotated thru 180° to a side by side alignment with boat section FIG. 1 wherein, top side wall hinge joints 3-4 and forequarter hinge joints 5-6 are engaged. Concurrently, hinge joint alignment plug 51 is inserted into its mating alignment socket 50. Upon installation of all required hinge joint connector pins O and their respective snap-rings OO, the two boat sections are joined together as an integral unit. Alternately, hinge joints 11-12 may be used as a pivot point with hinge joints 1-2 disconnected. In this arrangement, rear section FIG. 1 would be rotated thru 180° into side by side alignment with forward section FIG. 1, concurrently engaging hinge joints 9-10 and 7-8 with alignment plug 48 being inserted into alignment socket 49. Upon installation of all required hinge joint connector pins O and, all circular snap-rings OO, the two boat sections are joined together as an integral unit.

Conversion to an enclosed container, adapted for a variety of uses, may be made from either the fore and aft two boat section alignment or, from the side by side configuration. To convert from the fore and aft alignment FIG. 7, to the enclosed container shown in FIG. 9, first remove the bottom snap-ring from hinge joints 1-2 and 11-12 then, using the top snap-ring as a puller, remove both hinge joint connector pins. Wherein, forward section FIG. 1 or rear section FIG. 2 can be pivoted into an overlying position, one on the other. Lengthwise closure is practical when the enclosed container is to be used at floor or deck level for stowage.

Conversion to an enclosed container from a side by side boat section alignment may be made from either side. If hinge joints 3-4 are left connected and used as a pivot point, then, hinge joints 1-2 and forequarter hinge joint 5-6 are disconnected and, rear section is rotated thru 180° to an overlying relationship with forward section FIG. 1. If hinge joints 9-10 are left connected and used as a pivot, hinge joints 11-12 and forequarter hinge 7-8 are disconnected and, boat section FIG. 1 is rotated through 180° into an overlying relationship with rear section FIG. 1. This method of closure could be used when the container is used as a car-top luggage carrier. Once the two boat sections are in an overlying configuration, all hinge joint connector pins and their respective snap-rings would be installed.

To convert from fore and aft or side by side configuration into two independent boat section, simply remove all interconnecting hinge joint connector pins. The two independent boat sections may be envisaged in FIG. 1 with hinge joints 1-2 fully disconnected.

The boat sections may be fabricated from fiber-glass, marine plywood, aliminum or one of the new high impact plastics. The hinge joints and hinge joint connector pins would be made of stainless steel or bronze alloy. The circular snap-rings would be made of stainless steel. Both boat sections are to be nonsinkable with expanded polystyrene foam carried in the seats and bottom structure.

It is understood that the forms of this invention herewith shown and, described herein, are to be taken as illustrative embodiments only of the same and, that various changes, which are contemplated, in shape, size and arrangement of parts and structure, may be resorted to without departing from the spirit of the invention or, the scope of the subjoined claims.

While the present invention, as described herein, applies only to small boats, it is the intent of the invention to apply equally as well to larger pleasure and commercial craft and, to enclosures where the functionally designed beveled hinge joint inconjunction with the two boat section principal is advantageous. This is intended to include: truck and van bodies, roof top cargo carriers, items of a toy or educational classification and, the fabrication of kits to adapt and install the present invention on existing watercraft, boats and vehicles, irregardless of size or shape.

I claim:

1. A two section small boat structure comprising an independent forward section and a similar independent rear section; each section includes mating releasable hinge means permitting the two section to be interconnected into an integral small boat structure; each of said forward and rear sections comprising a substantially flat rectangular bottom wall and upstranding rear and side walls; said upstanding side walls and said flat bottom wall curving to a common apex to describe a pointed forward end; said flat bottom wall, upstanding side walls, upstanding rear wall and pointed forward end defining a closed, water tight periphery; each section further comprising a transverse center seat adapted to be removably secured and means defining a vertical aperture extending substantially one half the height of the vertical portion of an upstanding side wall and disposed at the pointed forward end of each section; said hinge means comprising first releasable hinge means disposed horizontally in two equal segments along the top transverse edge of the rear wall of each of the forward and rear sections; each first hinge means defining a horizontal aperture extending substantially the length equal to the vertical portion of an upstanding side wall for selectively pivotally interconnecting the rear walls of said sections whereby the forward and rear sections may be selectively pivoted into substantially longitudinal alignment to form a one section six passenger boat and, selectively pivoted, one section over the other, to form an enclosed container adapted to be opened from one end thereof;

second releasable hinge means disposed vertically along each corner of the rear wall of each said forward and rear sections for releasably interconnecting said rear walls of said forward and rear sections when the same are interconnected by said first releasable hinge means and maintained in the longitudinally aligned configuration to prevent relative pivoting movement of the sections about said first hinge means and, for selectively pivotally interconnecting said rear walls whereby, said forward section and said rear section may be pivoted, when disconnected from both first releasable hinge means and one second releasable hinge means, from a longitudinally aligned configuration into substantially side-by-side alignment to form a two section six passenger boat, said second releasable hinge means defining a vertical aperture extending substantially the height of the vertical portion of an upstanding side wall of said sections;

third releasable hinge means disposed lengthwise along both side wall top edges of each of said forward and rear section for selectively pivotally interconnecting said side walls when the same are connected by one said second releasable hinge means and maintained in the side-by-side, aligned configuration whereby, when not interconnected by said one second releasable hinge means, said forward section and said rear section may be selectively pivoted into an over-lying relationship to form an enclosed container adapted to be opened from either side thereof, said third releasable hinge means defining a horizontal aperture extending substantially the length equal to the height of the vertical portion of an upstanding side wall; means for releasably interconnecting said forward and rear sections when the same are interconnected by one said second and one said third releasable hinge means and maintained in a side-by-side configuration to prevent relative pivoting movement of the sections about said second and third hinge means, said interconnecting means disposed on both upstanding vertical side walls of said forward and rear sections fore quarter, just behind the curved portion of said upstanding side walls, said interconnecting means defining a vertical aperture, extending substantially the full vertical height of the vertical portion of said upstanding side walls; and means for aligning said releasable hinge means for preventing movement between each of said section's abutting surfaces when the sections are maintained in a side-by-side aligned configuration, said aligning means comprising a beveled round plug and a round mating socket; said plug and socket, when engaged, being disposed adjacent to each first releasable hinge means, when the sections are maintained in a longitudinally aligned configuration and, adjacent to each third releasable hinge means when the sections are maintained in a side-by-side aligned configuration; said beveled round plug having a diameter substantially equal to one fourth the length of an interconnected hinge means and a penetration depth of one-fifth the diameter of said beveled round plug, said socket being of a diameter and depth to accommodate said round beveled plug without binding and without movement of the plug when inserted within said socket.

2. The structure as defined in claim 1 wherein said first releasable hinge means, said second releasable hinge means, said third releasable hinge means and, said inter connecting means are all characterized by, a forty five degree bevel at all aperture entry and exit openings, all hinge means embody rounded corners and, a connector pin characterized by a fifteen degree taper at each end, said connector pin having a drilled passage at each end to accommodate a circular steel snap ring.

* * * * *